United States Patent [19]

Dorsch et al.

[11] 4,085,896

[45] Apr. 25, 1978

[54] APPARATUS AND SPRAY HEAD FOR FLUID DISPERSION

[75] Inventors: Robert Dorsch; Daryl Leach, both of Warren, Mich.

[73] Assignee: Alpha-Debon Industries, Inc., Troy, Mich.

[21] Appl. No.: 747,510

[22] Filed: Dec. 6, 1976

[51] Int. Cl.[2] ..... B05B 1/26

[52] U.S. Cl. ..... 239/504; 239/522; 239/523

[58] Field of Search ..... 239/521–524, 239/499, 504

[56] References Cited

U.S. PATENT DOCUMENTS

| | | | |
|---|---|---|---|
| 1,228,658 | 6/1917 | Gaines | 239/505 X |
| 1,434,757 | 11/1922 | Thomas | 239/498 |
| 1,521,863 | 1/1925 | Brockschmidt | 239/522 X |
| 1,705,188 | 3/1929 | Kelly | 239/522 |
| 3,369,760 | 2/1968 | Schaible | 239/513 |

*Primary Examiner*—John J. Love

*Attorney, Agent, or Firm*—Harness, Dickey & Pierce

[57] ABSTRACT

This disclosure relates to a new apparatus and spray head for fluid dispersion for use in removing particulate matter from air. The spray head comprises a rigid spray plate bent to a predetermined configuration with two head side plates attached to said spray plate, and two spray side guide bars attached to said side plates. A pressurized fluid, such as water, is delivered at the bottom of the spray plate whereupon impact with the surfaces of the spray plate, side plates and guide bars causes the fluid to be dispersed in spray form. Through this spray is passed contaminated air containing undesirable particulate matter such as paint overspray, whereupon the air is scrubbed to remove substantially all of the particulate matter. Such a spray head apparatus would typically be located at the base of a scrubbing unit connect to a paint spray booth or the like, said scrubber containing baffles through which contaminated air is passed and cleaned prior to emitting the remaining particle-free air to the atmosphere.

5 Claims, 4 Drawing Figures

APPARATUS AND SPRAY HEAD FOR FLUID DISPERSION

BACKGROUND OF THE INVENTION

1. Field of the Invention

The present invention pertains primarily to spray heads for fluid dispersion, and more particularly to spray heads for use in removing particulate matter from air.

2. Description of the Prior Art

Generally, spray nozzles for use in fluid dispersion are projecting openings or vents that direct the flow of fluid from a confined container or conduit into an open space. As an example, some nozzles maintain the fluid in a jet such as that used in an impulse turbine. Other nozzles disperse the fluid in an atomized mist, such as a cone nozzle for use in the combustion chamber of a furnace. The nozzle that may typically be attached to a fire hose or garden hose disperses fluid in spray form, with the spray being of specified shape and volume.

Spray heads for fluid dispersion for use in removing particles from air are usually of the spray type. Most prior art spray nozzles have been found to be unsatisfactory in removing undesirable particulate matter from contaminated air and virtually none are able to remove substantially all of the particulate matter.

It is a principal object of the present invention therefore to provide an improved apparatus and spray head for fluid dispersion for use in removing particulate matter from air.

It is a further object of the present invention to provide an apparatus and spray head for fluid dispersion which is capable of removing substantially all undesirable particulate matter from contaminated air.

It is another object of the present invention to provide a spray head of unique configuration, wherein the action of the fluid upon the spray head provides the spray mist.

Other objects, features and advantages of the present invention will become apparent from the subsequent description, and the appended claims taken in conjunction with the accompanying drawings.

SUMMARY OF THE INVENTION

In accordance with the present invention, an apparatus and spray head for fluid dispersion is provided which is capable of removing substantially all undesirable particulate matter from contaminated air. The spray head comprises a metal spray plate bent to a predetermined configuration with two head side plates attached to said spray plate, and two spray side guide bars attached to said side plates. When pressurized fluid, such as water, is delivered at the bottom of the spray plate and impacted with the surfaces of the spray plate, side plates and guide bars, a spray is formed which scrubs the contaminated air passing in front of the spray head. Clean air, substantially free of all particulate matter, is produced.

BRIEF DESCRIPTION OF THE DRAWINGS

The foregoing objects and others will be pointed out more fully hereinafter in conjunction with the description of the preferred embodiment of the present invention illustrated in the accompanying drawings and in which.

DESCRIPTION OF THE PREFERRED EMBODIMENT

Figure 1:
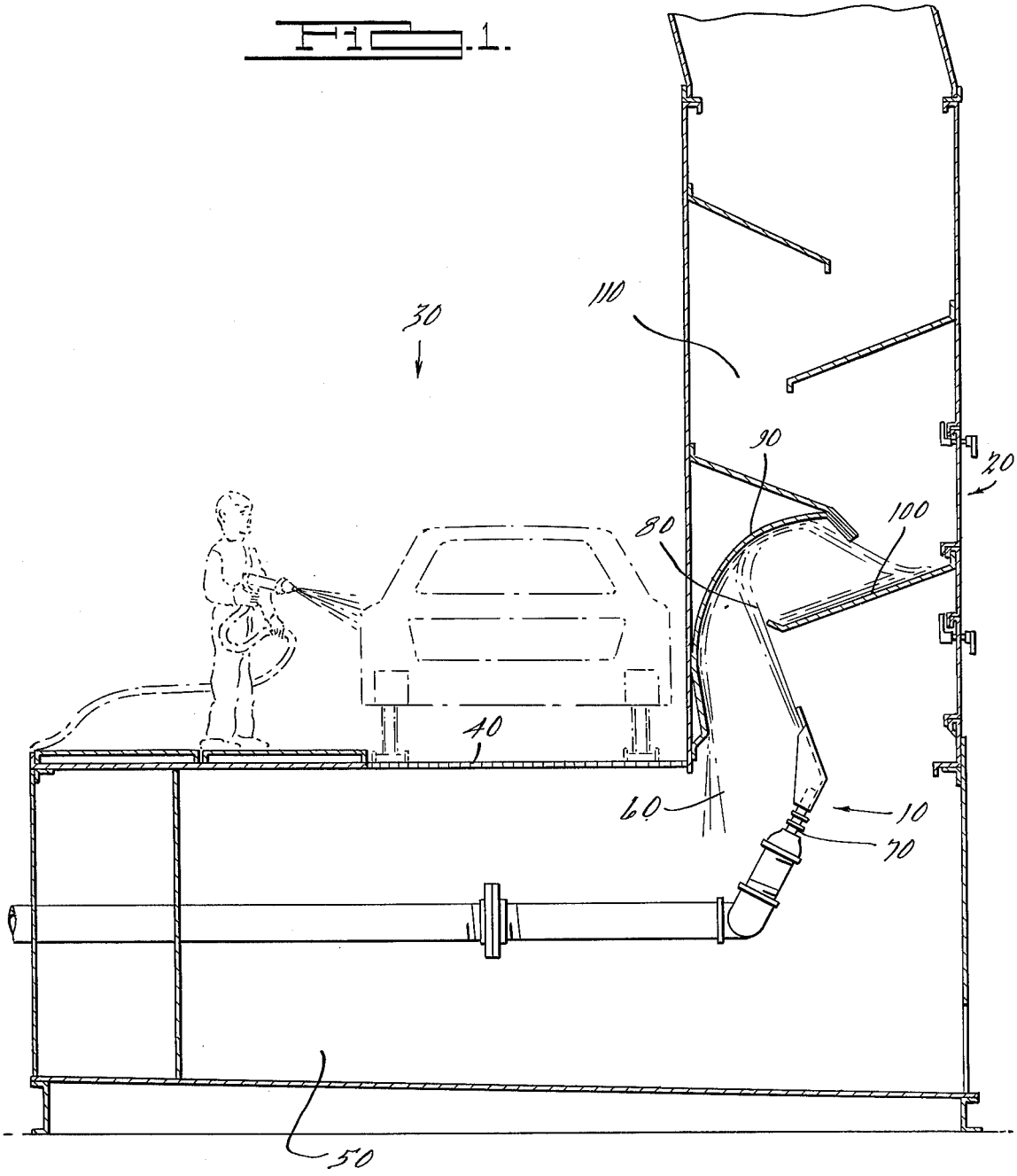
FIG. 1 is a cross-sectional view of a preferred embodiment of the present invention as shown in use in a scrubbing unit connected to an automotive paint spray booth.

Referring now to the drawings wherein the showings are for the purpose of illustrating a preferred embodiment of the invention only and are not for the purpose of limiting the invention, FIG. 1 shows the spray head 10 of the present invention in use in a scrubbing unit 20 connected to a paint spray booth 30. In an automobile assembly plant, contaminated air containing paint overspray would be drawn by suction force through grating 40, into water trough 50, and into the base section 60 of scrubbing unit 20. Water flowing through pipe 70 at about 80 pounds per square inch pressure and about 175 gallons per minute flow rate would impact the spray head 10 causing a water spray 80. This water spray 80 scrubs the contaminated air, removing most of the paint overspray particles in the region between curved baffles 90 and straight baffle 100. Any particles not removed in that step, proceed up the scrubbing unit to the upper section 110 where they are removed by water mist and the action of the upper baffles. It has been found that use of the present invention removes substantially all undesirable particulate matter such as paint overspray with an efficiency of about 99%. The remaining particle-free air proceeds from the scrubbing unit to exhaust vents to the atmosphere. In a typical automobile assembly plant several of such scrubbing units would be used side by side.

Figure 2:
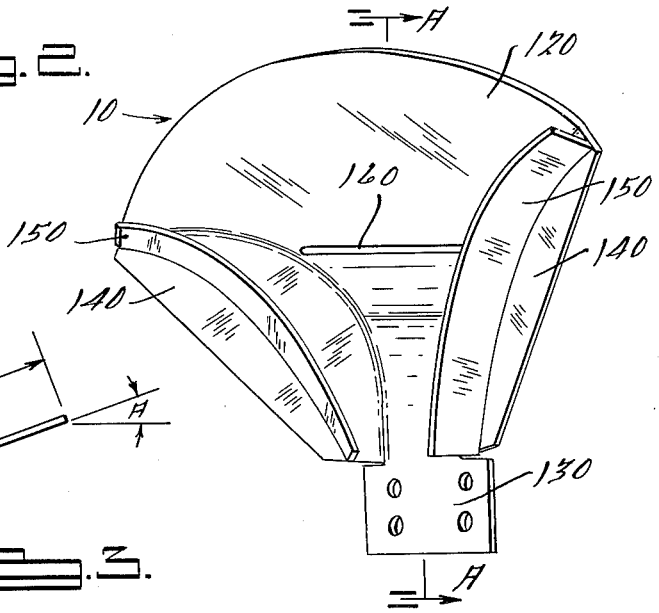
FIG. 2 is a perspective view of a preferred embodiment of the present invention.

FIG. 2 shows a perspective view of the spray head 10 of the present invention which in a preferred embodiment is made of steel sheet stock, with pieces welded thereto. The spray head 10 is comprised of a spray plate 120 which is bent in a predetermined radius to form an obtuse angle. Said spray plate 120 flares out beyond the bent portion. A head clamp plate 130 is attached to said spray plate 120 and serves as a mounting plate for the spray head 10. Two head side plates 140 are attached to either side of said spray plate 120, and two spray side guide bars 150, one attached to each head side plate 140, are welded at right angles to the head side plates 140. In this preferred embodiment of the present invention, the spray plate 120 contains a head slot 160 which functions to divert some water spray to the back side of the spray head 10, thus scrubbing any contaminated air which finds its way behind the spray head 10. The head clamp plate 130 and the two spray side guide bars 150 are made of thicker sheet metal stock in this embodiment to furnish extra rigidity.

Figure 3:
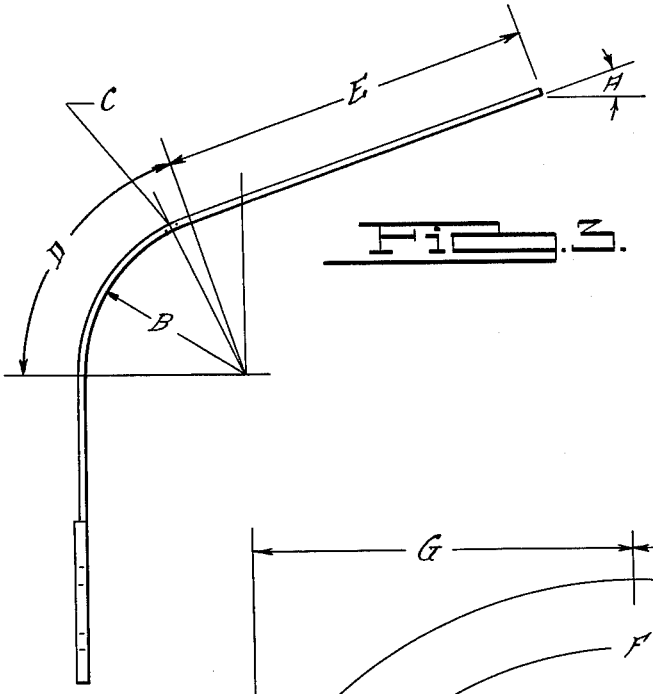
FIG. 3 is a side view of a preferred embodiment of the present invention through section A—A.
Figure 4:
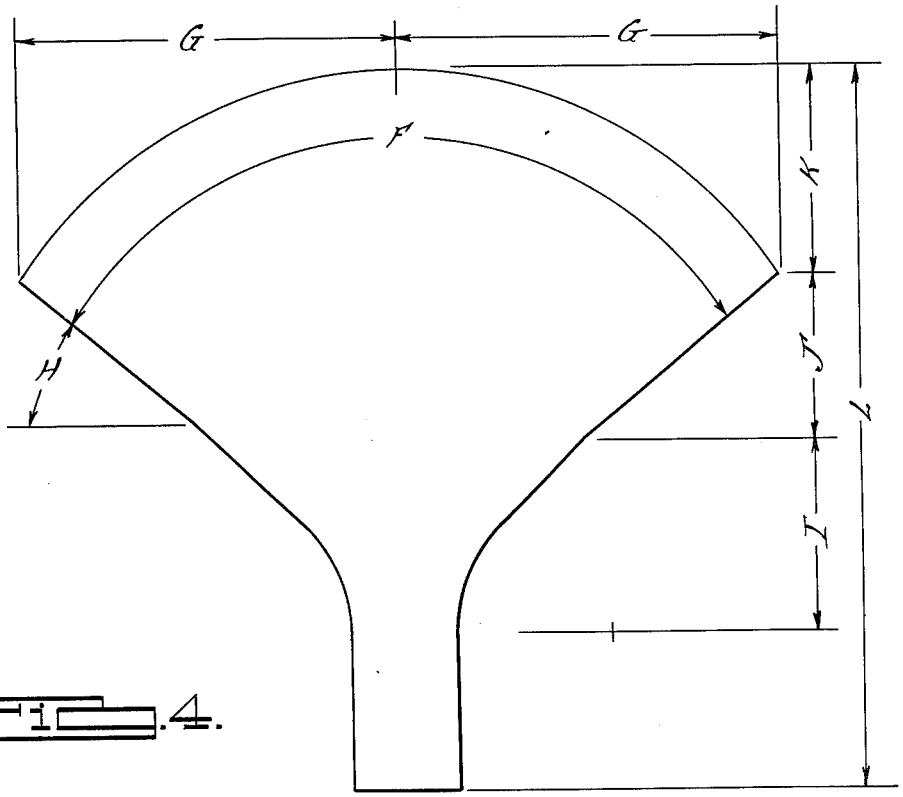
FIG. 4 is a stretch-out view of the spray plate portion only of a preferred embodiment of the present invention.

FIG. 3 shows a side view of a preferred embodiment of the present invention through section A—A. FIG. 4 is a stretch-out view of the spray plate portion only of the same preferred embodiment. Both of these figures contain letters which correspond to the possible preferred dimensions listed in Table 1. The variables listed in Table 1 are examples of dimensional relationships which have proven successful in operation.

TABLE 1

| Variable | Description |
|---|---|
| A | From 5° to 65°, varies with "D" |
| B | From 2 inches to 6 inches |
| C | From ¼ inch to ¾ inch |
| D | From 85° to 25° |
| E | From 4 inches to 12 inches |
| F | From 60° to 120° |
| G | Varies with "F" |
| H | Varies with "F" |
| I | Varies with "B" and "D" |
| J | Varies with "F" |
| K | Varies with "F" |
| L | Varies with "F", "B", and "D" |

Variables B, D and F are the most critical. The total angle formed by the spray plate is variable A plus 90°.

It should be noted that the dimensions of the head side plates and spray side guide bars vary with the dimensions of the spray plate and are adapted for mating thereto. None of the dimensions shown above should be deemed to be limiting and are only suggestions of possible dimensional relationships which have been shown to provide an effective way of practicing this invention.

It has been found that the use of the preferred embodiment described in the proceding paragraphs is capable of removing substantially all undesirable particulate matter such as paint overspray from contaminated air. Tests made on the air exiting the upper portion of a scrubbing unit attached to a paint spray booth in an automobile assembly plant have indicated that over 99% of the airborne paint overspray particles can be removed. With the increased attention being given to air quality and environmental standards in recent years, such performance is now a requirement and at least a goal of most manufacturers faced with particle contamination of air emissions.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

What is claimed is:

1. An apparatus for removing particulate matter from air wherein contaminated air containing undesirable particulate matter is passed through a fluid spray whereupon said air is scrubbed to remove substantially all of the undesirable particulate matter, wherein said fluid spray is produced upon the impact of pressurized fluid with the surface of a spray head comprising a rigid bent spray plate with two rigid head side plates attached thereto, and two rigid spray side guide bars attached to each of said side plates, wherein said spray plate is bent in a radius of from about 2 inches to about 6 inches to form an angle of between about 95° to about 155°, and wherein said spray plate flares out beyond the bent portion extending through an angle of between about 60° to about 120°.

2. The apparatus of claim 1 wherein said rigid bent spray plate, said rigid head side plates, and said rigid spray side guide bars are all made of metal.

3. The apparatus of claim 1 wherein said rigid bent spray plate, said rigid head side plates, and said rigid spray side guide bars are all made of steel.

4. The apparatus of claim 1 wherein said rigid bent spray plate contains a head slot extending the width thereof at a point near the end of the bent portion of said spray plate.

5. The apparatus of claim 1 wherein said spray plate is bent in a radius of about 3 inches to form an angle of about 110°, and wherein said flare extends through an angle of about 100°.

* * * * *